US005080810A

United States Patent [19]

Smith et al.

[11] Patent Number: 5,080,810

[45] Date of Patent: Jan. 14, 1992

[54] FABRIC SOFTENER FOR LAUNDRY DRYER SHEET

[75] Inventors: Kim R. Smith; Terry Crutcher; Joe D. Sauer; Jeffrey W. Perine; James E. Borland, all of Baton Rouge, La.

[73] Assignee: Ethyl Corporation, Richmond, Va.

[21] Appl. No.: 652,615

[22] Filed: Feb. 8, 1991

[51] Int. Cl.[5] ..... D06M 10/08; C11D 7/32

[52] U.S. Cl. ..... 252/8.6; 252/8.7; 252/8.8; 252/8.9; 252/90; 252/547

[58] Field of Search ..... 252/8.6, 8.7, 8.75, 252/8.8 R, 8.9, 547, 90

[56] References Cited

U.S. PATENT DOCUMENTS

| | | | |
|---|---|---|---|
| 3,609,075 | 9/1971 | Barbera | 252/8.8 R |
| 4,264,457 | 4/1981 | Beeks et al. | 252/8.8 |
| 4,486,195 | 12/1984 | Weinstein | 252/8.8 |
| 4,585,563 | 4/1986 | Busch et al. | 252/8.8 |
| 4,639,321 | 1/1987 | Barrat et al. | 252/8.9 |

*Primary Examiner*—Paul Lieberman
*Assistant Examiner*—William S. Parks
*Attorney, Agent, or Firm*—Patricia J. Hogan

[57] ABSTRACT

The softness of laundered fabrics, such as cotton fabrics, is improved by drying them in the presence of a laundry dryer sheet containing as the fabric softener a mixture or 50–80% by weight of N-dihydrogenatedtallow-N,N-dimethylammonium chloride and 50–20% by weight of N-octadecyl-N,N-dimethylamine oxide.

5 Claims, No Drawings

FABRIC SOFTENER FOR LAUNDRY DRYER SHEET

FIELD OF INVENTION

This invention relates to laundry dryer sheets and more particularly to such sheets incorporating a synergistic mixture of surfactants as a fabric softener.

BACKGROUND

When fabrics are laundered, it is frequently desirable to treat them with fabric softeners, not only to soften them, but to give them greater bulk, make them easier to iron, decrease fabric drying time, and reduce static charge. A fabric softener that is commonly used in laundry detergents, rinses, and dryer sheets, such as the dryer sheets of U.S. Pat. No. 3,686,025 (Morton), is N-dihydrogenatedtallow-N,N-dimethylammonium chloride (DTMAC), which is both inexpensive and effective as a softener but, on the other hand, has certain deficiencies, such as its yellowing and reducing the washability of the softened fabrics, having inefficient antistatic activity on polyesters, and decreasing the rewettability of the treated fabrics.

Amine oxides are also known to be useful as fabric softeners, including softeners incorporated into laundry dryer sheets. When thus utilized, they have most commonly been employed as dilute aqueous solutions. However, copending application Ser. No. 07/591,214 (Corona et al.) discloses that the use of solid amine oxides instead of conventional dilute aqueous solutions in preparing the dryer sheets permits the elimination of a bothersome drying step and increases the loading of amine oxide that can be incorporated. The solid amine oxides which are used by Corona et al. are the mixed tert-amine oxides of copending application Ser. No. 07/591,425 (Borland et al.), i.e., tert-amine oxides containing at least one long-chain group and at least one short-chain group, in which at least some of the molecules are dihydrate molecules.

SUMMARY OF INVENTION

It has now been found that, when the fabric softener is used in a laundry dryer sheet, greater softness can be imparted to the laundered fabric when the softener is a mixture of 50–80% by weight of N-dihydrogenatedtallow-N,N-dimethylammonium chloride and 50–20% by weight of N-octadecyl-N,N-dimethylamine oxide than when either component of the mixture is used alone, since the components are synergistic in the specified proportions.

DETAILED DESCRIPTION

The laundry dryer sheet of the invention may be prepared by the conventional technique of soaking an absorbent flexible substrate with an aqueous mixture of the fabric softener components, pressing the resultant soaked sheet to remove any excess surfactant, and then drying it. However, it is preferably prepared by coating an absorbent flexible substrate with a molten mixture of the fabric softener components and then solidifying the mixture.

The absorbent flexible substrate used in preparing the dryer sheets may be any of the substrates typically employed in making such sheets, since the only requirement for the substrate is that it be an absorbent material in sheet form. For example, it may be a sponge, paper, or woven or non-woven cloth, especially a non-woven cloth made from fibers or filaments of a material such as wool, silk, jute, hemp, cotton, linen, sisal, ramie, rayon, cellulose esters, vinyl polymers, polyamides, polyesters, and the like. A particularly desirable substrate is a sheet of non-woven polyethylene terephthalate cloth.

As already indicated, the fabric softener with which the substrate is soaked may be an aqueous or a molten mixture of the fabric softener components. The N-dihydrogenatedtallow-N,N-dimethylammonium chloride (DTMAC) used in preparing both types of mixtures is generally the material that is most commonly available, i.e., a 75% paste in an alcohol. However, it is usually preferred to utilize different N-octadecyl-N,N-dimethylamine oxide (AO-18) materials in preparing the different types of mixtures, since the conventional dilute aqueous solutions are more conveniently employed in making aqueous mixtures, while it is more practical to use a solid material when it is desired to have a molten mixture.

When a solid AO-18 is to be used and is not commercially available, it may be prepared by the process of Borland et al., the teachings of which are incorporated herein by reference. More specifically, it may be prepared by (1) oxidizing N-octadecyl-N,N-dimethylamine with aqueous hydrogen peroxide in an organic solvent in which both the amine and amine oxide are soluble at the reaction temperatures but in which the amine oxide is insoluble at a lower temperature and (2) adjusting the water content of the product, if necessary, to achieve a water/amine oxide mol ratio not higher than about 2.1/1 before the amine oxide is recovered. In this reaction:

(A) the aqueous hydrogen peroxide is employed in at least a stoichiometric amount, and its amount and concentration are preferably such as to make it unnecessary to adjust the water content of the product at the end of the reaction, (B) the organic solvent is used in an amount sufficient to maintain a stirrable reaction mixture and is preferably ethyl acetate, although other substantially inert esters, hydrocarbons, halohydrocarbons, and highly polar aprotic solvents are also usable, (C) the reaction is conducted by adding the aqueous hydrogen peroxide to the amine, preferably at a controlled rate and preferably in the presence of carbon dioxide or a chelating agent (such as diethylenetriaminepentaacetic acid) to improve the reaction rate, at a temperature of 20°–100° C., preferably about 25°–80° C., and (D) the reaction mixture is cooled at the end of the reaction to precipitate the amine oxide.

When the product of this reaction has a water/amine oxide mol ratio in the range of about 1.9–2.1/1 at the time that the amine oxide is recovered, the amine oxide is recovered as a dihydrate. When the water/amine oxide mol ratio is lower than about 1.9/1, the recovered amine oxide contains some dihydrate molecules as well as monohydrate and anhydrous molecules.

The process of the invention is conveniently conducted by soaking the absorbent flexible substrate in a molten mixture of the fabric softener components, thus coating and inherently impregnating it with the surfactants; passing the soaked sheet between two rollers, as in a roller press, to remove any excess surfactant; and allowing the remaining surfactant to solidify.

The invention is advantageous in that the use of the fabric softener mixtures in laundry dryer sheets leads to greater softness of laundered fabrics, e.g., cotton fabrics, than can be achieved when either component of the mixture is used alone as the fabric softener. Optimum results are achieved when the fabric softener is a mixture of about 75% by weight of DTMAC and about 25% by weight of AO-18.

The following example is given to illustrate the invention and is not intended as a limitation thereof. Unless otherwise specified, quantities mentioned in the example are quantities by weight.

EXAMPLE

Fifty cotton hand-towels were washed on medium loading for 30 minutes in the presence of 37.5 g of an anionic laundry detergent and divided into five groups of ten towels, each group then being loaded into an automatic dryer and dried for 60 minutes on "normal" at about 65° C. in the presence of a polyester dryer sheet having a 1 g loading of softener. The softeners used for the five different dryer sheets were:

(A) 100% AO-18, (B) 75% AO-18 and 25% DTMAC, (C) 50% AO-18 and 50% DTMAC, (D) 25% AO-18 and 75% DTMAC, and (E) 100% DTMAC.

The softness of the dried towels was evaluated by a panel of evaluators who ranked them from 5 (softest) to 1 (least soft). The results of the evaluation are shown below.

| | |
|---|---|
| 100% AO-18 | 2.7 |
| 75% AO-18/25% DTMAC | 2.5 |
| 50% AO-18/50% DTMAC | 3.3 |
| 25% AO-18/75% DTMAC | 3.6 |
| 100% DTMAC | 3.0 |

What is claimed is:

1. A laundry dryer sheet comprising a flexible absorbent substrate impregnated with a mixture of 50–80% by weight of N-dihydrogenatedtallow-N,N-dimethylammonium chloride and 50–20% by weight of N-octadecyl-N,N-dimethylamine oxide as a fabric softener.

2. The laundry dryer sheet of claim 1 wherein the fabric softener is a mixture of about 75% by weight of the substituted ammonium chloride and about 25% by weight of the amine oxide.

3. A process for improving the softness of a laundered fabric which comprises drying the laundered fabric in an automatic dryer containing a laundry dryer sheet of claim 1.

4. The process of claim 3 wherein the fabric softener in the dryer sheet is a mixture of about 75% by weight of the substituted ammonium chloride and about 25% by weight of the amine oxide.

5. The process of claim 4 wherein the fabric is cotton.

* * * * *